US008448315B2

(12) United States Patent
Rensink

(10) Patent No.: US 8,448,315 B2
(45) Date of Patent: May 28, 2013

(54) HIGH COMFORT MATTRESSES HAVING FIBERBALLS

(75) Inventor: Robert L. Rensink, Denver, CO (US)

(73) Assignee: Denver Mattress Co., LLC, Denver, CO (US)

( * ) Notice: Subject to any disclaimer, the term of this patent is extended or adjusted under 35 U.S.C. 154(b) by 213 days.

(21) Appl. No.: 12/954,240

(22) Filed: Nov. 24, 2010

(65) Prior Publication Data

US 2011/0067215 A1 Mar. 24, 2011

Related U.S. Application Data

(63) Continuation of application No. 12/619,286, filed on Nov. 16, 2009, now abandoned, which is a continuation of application No. 11/876,629, filed on Oct. 22, 2007, now Pat. No. 7,617,788, which is a continuation of application No. 11/115,722, filed on Apr. 26, 2005, now Pat. No. 7,284,494, which is a continuation-in-part of application No. 10/740,879, filed on Nov. 10, 2003, now Pat. No. 6,895,620.

(51) Int. Cl.

| | |
|---|---|
| ***B68G 7/00*** | (2006.01) |
| ***D05B 11/00*** | (2006.01) |
| ***B32B 7/08*** | (2006.01) |

(52) U.S. Cl.

USPC ..... 29/91.1; 29/91; 112/475.08; 112/420; 5/716

(58) Field of Classification Search

USPC ..... 29/91, 91.1; 5/716, 720, 721, 737, 5/740, 952, 953; 112/420, 475.08

See application file for complete search history.

(56) References Cited

U.S. PATENT DOCUMENTS

| | | | | | |
|---|---|---|---|---|---|
| 1,564,868 | A | * | 12/1925 | Lindsay | 112/2.1 |
| 2,493,652 | A | * | 1/1950 | Bowersox | 53/438 |
| 2,862,214 | A | | 12/1958 | Thompson et al. | |
| 3,200,418 | A | * | 8/1965 | Lebens | 5/721 |
| 3,562,825 | A | * | 2/1971 | Larsen | 5/721 |
| 3,579,774 | A | * | 5/1971 | Shreve | 29/91.1 |
| 3,869,739 | A | | 3/1975 | Klein | |
| 4,463,466 | A | | 8/1984 | May et al. | |
| 5,040,255 | A | | 8/1991 | Barber, Jr. | |
| 5,112,684 | A | * | 5/1992 | Halm et al. | 428/357 |
| 5,317,768 | A | | 6/1994 | Klancnik | |
| 5,344,707 | A | * | 9/1994 | Snyder | 428/359 |
| 5,469,590 | A | | 11/1995 | Simon | |
| 5,787,532 | A | * | 8/1998 | Langer et al. | 5/717 |
| 6,023,803 | A | | 2/2000 | Barman | |
| 6,115,859 | A | * | 9/2000 | Ozawa | 5/690 |
| 6,243,900 | B1 | | 6/2001 | Gladney et al. | |
| 6,292,965 | B1 | | 9/2001 | Gambrell | |
| 6,295,676 | B1 | | 10/2001 | Warner | |

(Continued)

FOREIGN PATENT DOCUMENTS

| | | | | |
|---|---|---|---|---|
| DE | 8809029.9 | | | 2/1989 |
| JP | 02118147 | A | * | 5/1990 |
| SU | 1505492 | A | * | 9/1989 |

*Primary Examiner* — Essama Omgba

(74) *Attorney, Agent, or Firm* — Kilpatrick Townsend & Stockton LLP

(57) ABSTRACT

In one embodiment, a mattress is constructed of a core having a first side and a second side. A padding layer is positioned at the first side of the core and has a contoured surface and a planar surface. A layer of individual fiberballs is disposed on the planar surface of the padding layer.

17 Claims, 7 Drawing Sheets

U.S. PATENT DOCUMENTS

| | | | | |
|---|---|---|---|---|
| 6,408,469 | B2 | 6/2002 | Gladney et al. | |
| 6,643,876 | B2 * | 11/2003 | Visser et al. | 5/720 |
| 6,701,557 | B2 | 3/2004 | Barman | |
| 6,786,164 | B2 * | 9/2004 | Myers et al. | 112/475.08 |
| 6,895,620 | B1 * | 5/2005 | Rensink | 5/721 |
| 7,051,389 | B2 * | 5/2006 | Wassilefky | 5/636 |
| 7,284,494 | B2 * | 10/2007 | Rensink | 112/475.08 |
| 7,617,788 | B2 * | 11/2009 | Rensink | 112/475.08 |
| 2002/0184712 | A1 | 12/2002 | Gladney et al. | |
| 2005/0210592 | A1 * | 9/2005 | Littlehorn et al. | 5/655 |
| 2006/0083911 | A1 * | 4/2006 | Ogle et al. | 428/297.4 |
| 2010/0029163 | A1 * | 2/2010 | Ogle et al. | 442/414 |
| 2010/0115703 | A1 * | 5/2010 | Kluft | 5/717 |

* cited by examiner

HIGH COMFORT MATTRESSES HAVING FIBERBALLS

CROSS-REFERENCES TO RELATED APPLICATIONS

This application is a continuation of U.S. patent application Ser. No. 12/619,286, filed Nov. 16, 2009 now abandoned, which is a continuation of U.S. patent application Ser. No. 11/876,629, filed Oct. 22, 2007 now U.S. Pat. No. 7,617,778, which is a continuation of U.S. patent application Ser. No. 11/115,722, filed Apr. 26, 2005 now U.S. Pat. No. 7,284,494 which is a continuation in part of and claims the benefit of U.S. application Ser. No. 10/704,879, filed Nov. 10, 2003 now U.S. Pat. No. 6,895,620. This application is also related to copending U.S. application Ser. No. 10/705,640, filed Jan. 10, 2003, the complete disclosure of this application is herein incorporated by reference.

BACKGROUND OF THE INVENTION

This invention relates generally to the field of mattresses, and in particular to high comfort mattresses. More specifically, the invention relates to arrangements of padding layers that may be used in combination with a mattress core to increase the comfort level of a mattress.

An uncomfortable mattress can be a significant factor in contributing to a poor night's sleep. Traditionally, mattresses have been constructed using a core of springs topped with a layer of padding. Some manufacturers have incorporated this padding into the quilting. Such mattresses are generally referred to as pillow top mattresses.

One way to improve the comfort level of a mattress is to utilize a piece of convoluted polyurethane foam as the padding layer. To reduce the "lumpiness" of this padding layer, some manufacturers have placed fibers in the valleys created by the convolutions. One example of this approach is described in U.S. Pat. No. 5,317,768, the complete disclosure of which is herein incorporated by reference. This design can be undesirable because the fibers can matte down in the valleys so that the convolutions lose their cushioning effect.

BRIEF SUMMARY OF THE INVENTION

The invention provides a variety of high comfort mattress systems and methods for making such mattresses. In one embodiment, a mattress comprises a core having a first side and a second side. The mattress also includes a first padding layer that is positioned at the first side of the core. The first padding layer has at least one contoured surface. A second padding layer is adjacent to the contoured surface. By using a padding layer against the contoured surface, the "lumpiness" of the mattress is eliminated while still permitting the contoured surface to reduce the pressure points on a sleeper's body. Also, this combination of materials better conforms to the shape of the sleeper's body. In this way, a luxurious feel is produced. Also, by using a contoured padding layer, material costs can be reduced because two pieces of a contoured material can be produced from a single layer of padding material. The first and second padding layers may be incorporated into the quilting or ticking (such by using a gusset) to form a pillow top mattress, or may be by incorporated directly into the mattress, known as a plush top arrangement.

In one aspect, the first and second padding layers may be constructed of a polyurethane foam. The contoured surface may also be convoluted, such as with an egg carton design having alternating peaks and valleys. The second padding layer may have a density in the range from about 0.5 pounds to about 1.9 pounds per cubic foot, and more preferably from about 0.5 pounds to about 0.9 pounds per cubic foot. In some cases, the density of the first padding layer may be larger than the second padding layer. The second padding layer may also have a mean indentation force deflection (IFD) in the range from about 5 to about 23, and more preferably from about 5 to about 15.

In one particular arrangement, the contoured surface may face away from the core so that the first layer is between the core and the second layer. Alternatively, the contoured surface may face toward the core so that the second layer is between the core and the first layer. In a further arrangement, an intermediary layer may be placed between the core and the first and second padding layers. Types of materials that may be used for the intermediary layer include polyurethane foams, latex rubber, visco-elastic or memory materials, densified fibers and the like.

The first and second layers may have a thickness in the range from about ⅜ inches to about 3 inches. The intermediary layer may have a thickness in the range from about 0.5 inches to about 3 inches.

A wide variety of mattress cores may be used. For example, the core may comprise springs, including open coil springs, pocketed springs, and the like. Other types of cores include those made from latex rubber, polyurethane foam, visco-elastic materials, air bladders, waterbeds and the like.

The mattress may also include a ticking layer on top of the padding layers. Also, an arrangement of padding layers that are on the first side of the core may also be included at the second side of the core. In some cases, the arrangement on the second side could be different from the first side.

In some cases, two second padding layers may be used in combination with the first padding layer having the contoured surface. The second padding layers may both be positioned on top of the first layer, or one may be above and one below. In another alternative, the mattress may include two first layers of foam that are convoluted in combination with the second layer. For example, the two first layers may have their contoured surfaces facing up, with the second layer resting on the contoured surface of the top first layer. As another example, one of the first layers may having its contoured surface facing up with the other first layer having its contoured surface facing down. The second layer rests on the contoured surface of the top first layer.

In another embodiment, the invention describes a mattress that comprises a core having a first side and a second side. A padding layer is positioned at the first side of the core and may have a contoured surface and a planar surface. A layer of individual fiberballs is disposed on the planar surface of the padding layer. The use of fiberballs on the padding layer makes the sleeping surface more resilient and provides the user with additional comfort. The fiberballs may also reduce the cost of the mattress while providing a more luxurious feel. Further, the fiberballs permit increased air circulation within the mattress to wick away body moisture and to disperse body heat away from the user.

In one aspect, the fiberballs may comprise a plurality of randomly arranged and entangled fibers having a size in the range from about 1 mm to about 20 mm. The fibers may in turn comprise polyester fibers having a cut length up to about 100 mm. These fibers may be arranged in a variety of configurations. For example, the fibers may be conjugated or spirally crimped. In another aspect, the layer of fiberballs may have a density that is in the range from about 0.5 ounces per square foot to about 3 ounces per square foot.

In a particular aspect, the padding layer may comprise a polyurethane foam with a convoluted surface that faces toward the core. Optionally, one or more padding materials may be disposed between the core and the padding layer. Such padding materials may be materials such as polyurethane foams, latex and visco-elastic materials.

In a further aspect, the mattress may include a ticking and a connector material. In this way, the layer of fiberballs and the padding layer may be disposed between the ticking and the connector material. In some embodiments, one or more padding layers could be included over the layer of fiberballs so as to sit between the ticking and the layer of fiberballs. Examples of such padding layers include foam materials, with or without convolutions or contours, visco elastic materials and the like. If convolutions are used, the convolutions may be facing the layer of fiberballs.

The invention further provides an exemplary method for constructing a mattress. The method may utilize a mattress core having a first side and a second side. A padding layer is arranged above the first side and a plurality of fiberballs are blown onto the padding layer. Also, the fiberballs are enclosed within a ticking so that the fiberballs are held between the ticking and the padding layer.

One particular aspect of the method is that the ticking may be sewn to a nonwoven material disposed beneath the padding layer substantially immediately after blowing the fiberballs onto the padding layer. In this way, a continuous manufacturing process may be used where the ticking is sewn to the nonwoven material as the fiberballs are being blown over the padding layer. To do so, a quilting machine may be used that incorporates equipment that blows the fiberballs over the padding layer while the ticking is being sewn to the nonwoven material. In this manner, a generally even layer of fiberballs is produced in a relatively fast manner. In one aspect, the method provides for continuing to deposit the blown supply of fibrous material as the quilting machine stitches behind the deposited fibrous material.

In another aspect, the padding layer may comprise a foam material having a contoured surface and a planar surface, with the contoured surface facing toward the first side of the mattress core. With this configuration, the fiberballs are blown onto planar surface. Optionally, an intermediary material may be placed between the padding layer and the mattress core. Also, another padding layer and another fiberball layer may be placed at the second side of the mattress core.

DETAILED DESCRIPTION OF THE INVENTION

Figure 1:
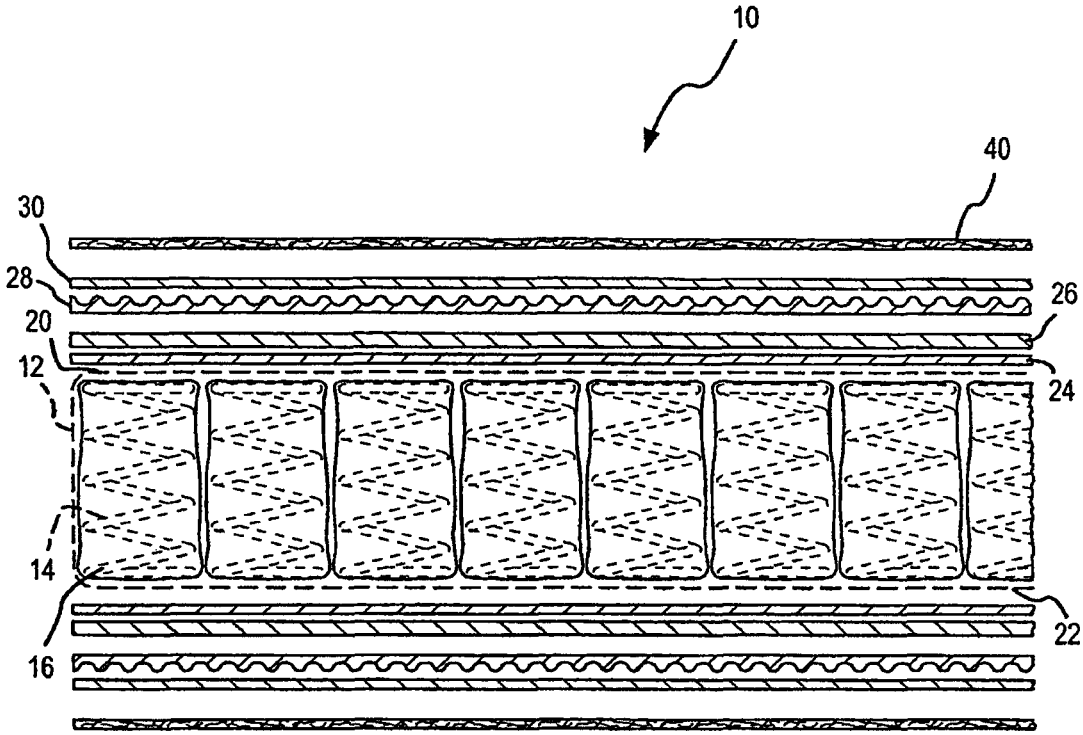
FIG. 1 is an exploded, schematic side view of an embodiment of a mattress according to the invention.
Figure 2:
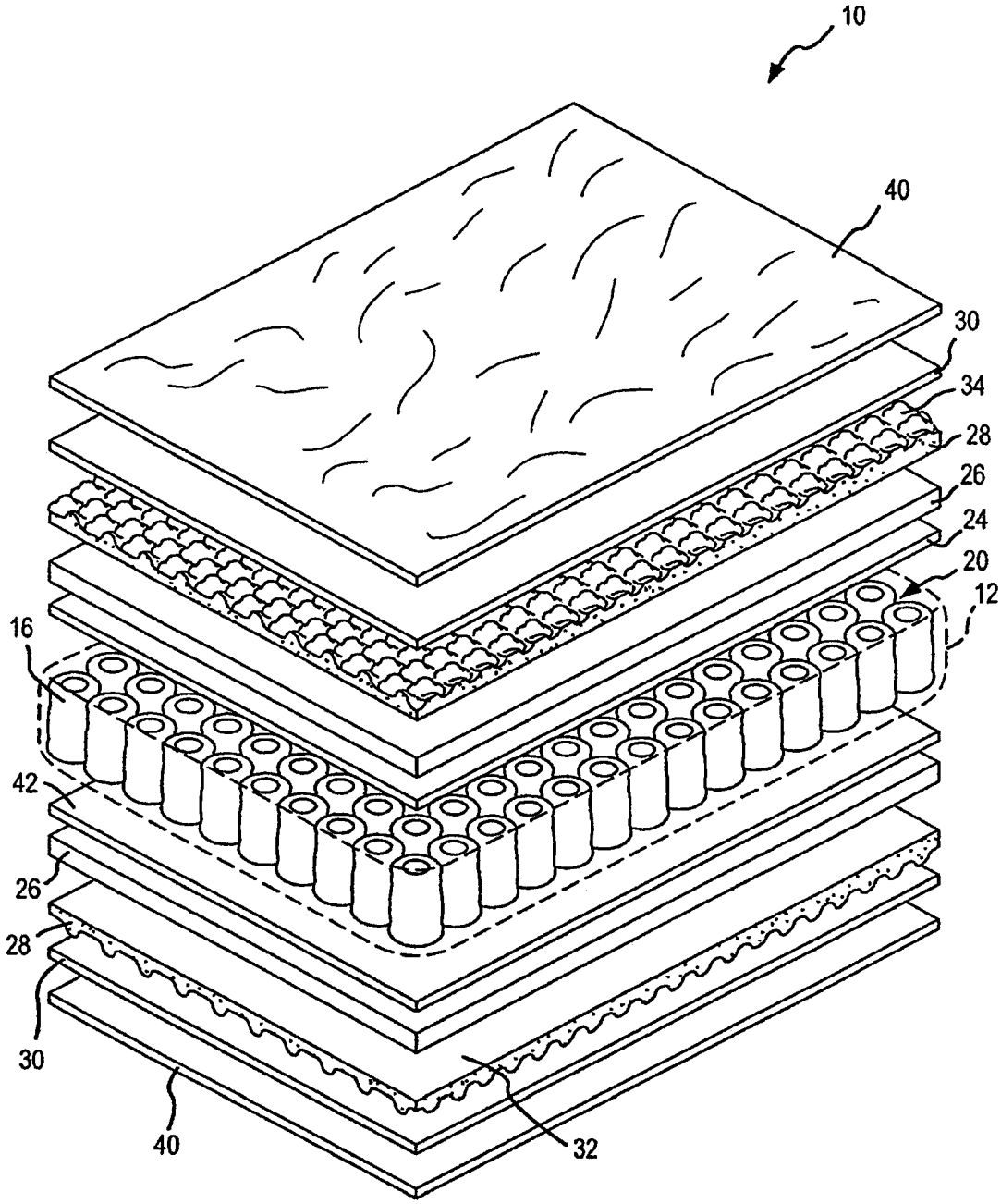
FIG. 2 is a perspective view of the mattress of FIG. 1.

The invention provides a variety of mattresses that provide a high level of comfort at reasonable manufacturing costs. The mattresses may utilize a variety of cores and a variety of padding layers arranged in a variety of ways. One example of a high comfort mattress is illustrated schematically in FIG. 1.

Mattress 10 utilizes a core 12 that provides the basic layer of support to the user's body. Mattress 10 may be used with essentially any type of core 12. For example, core 12 may comprise springs 14 that are encased in fabric pockets 16. Other cores include traditional open coil springs, latex rubber cores, visco-elastic cores, polyurethane cores, air bladders, waterbed cores, and the like. Hence, the invention is not intended to be limited to only a specific type of core. A border rod may be used to couple the core to an adjacent layer, although in some instances a foam casing or other border material may be placed around the core and the other layers.

For convenience of discussion, core 12 may have a first side 20 and a second side 22. A variety of optional padding layers and/or fabrics may be positioned adjacent to first side 20. For instance, a backing material (such as a nonwoven material, a fiber pad, a fine wire material, or the like) may be placed next to core 12 for protection of core 12. One or more intermediate padding layers (such as layers 24 and 26) may be used to provide the mattress with additional comfort. These layers may be used alone or in various combinations. For example, layer 24 may comprise a foam material, such as a polyurethane foam. One particular type of polyurethane foam that may be used is one having a density in the range from about 0.5 pounds per cubic foot to about 1.9 pounds per cubic foot, and more preferably from about 0.5 pounds per cubic foot to about 0.9 pounds per cubic foot. The firmness of layer 24 may be in the range from about 5 IFD to about 23 IFD, and more preferably from about 5 IFD to about 15 IFD. Layer 24 may have a thickness in the range from about 0.5 inches to about 3 inches, and could have one or more convoluted surfaces. Polyurethane foams with such characteristics are manufactured under the trade name Quiltflex from FoamEx, Inc, although other manufacturers may be used as well.

Layer 26 may comprise a piece of latex rubber or a visco elastic material. One or both sides of layer 26 could also be convoluted or surface modified in other shapes. Layer 26 may have a thickness in the range from about 0.5 inches to about 5 inches. Other materials that may be used as an intermediate layer include densified fiber materials.

Mattress 10 also includes a combination of padding layers 28 and 30. As will be described in more detail hereinafter, one of layers 28 or 30 may have a contoured surface, and the other padding layer is placed adjacent to the contoured surface. The contoured surface may have a variety of configurations. For example, one type of contoured surface is a convoluted surface having alternating peaks and valleys similar to an egg carton. One example of this type of surface design is described in U.S. Pat. No. 5,317,768, incorporated herein by reference. Other types of contoured surfaces include ribs, zigzags, other surface modified foams that may have essentially any type of design, including patterns defining regions of higher and lower firmness, and the like.

Figure 3:
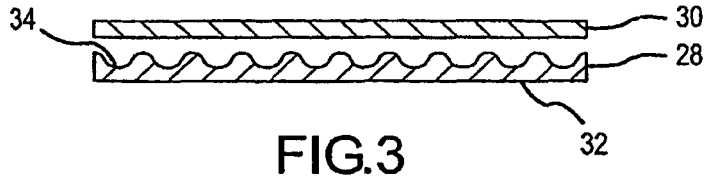
FIG. 3 is a side view of a convoluted foam layer adjacent another padding layer according to one embodiment of the invention.
Figure 4:
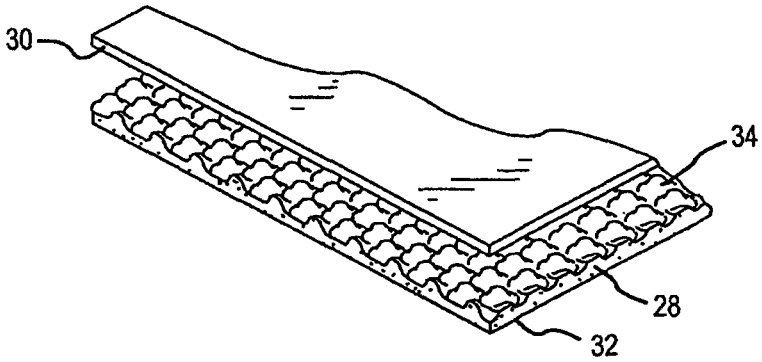
FIG. 4 is a perspective view of the arrangement of FIG. 3.

The padding layer having the contoured surface may be constructed from a polyurethane foam, although other materials could be used as well. As illustrated in FIGS. 3 and 4, layer 28 comprises a polyurethane foam having a flat surface 32 and a convoluted surface 34 that faces away from core 12.

In this way, layer 28 is positioned between layer 30 and core 12. Layer 28 may have a density in the range from about 0.5 pounds per cubic foot to about 3 pounds per cubic foot, and sometimes from about 1.6 pounds per cubic foot to about 1.9 pounds per cubic foot. Layer 28 may have a firmness in the range from about 8 IFD to about 45 IFD. Layer 28 may have a thickness in the range from about ⅜ inches to about 3 inches, and sometimes about 1 inch to about 1.5 inches. Conveniently, the peaks may be about half the total thickness of layer 28.

Layer 30 provides a variety of important features when placed against the peaks of convoluted surface 34. Layer 30 when placed adjacent the peaks of layer 28 better conforms to the user's body as compared to just a convoluted surface. This provides additional comfort to the user. Further, because of the density and firmness of layer 30, it alone has a luxurious feel. When used in combination with convolutions, a high degree of comfort is provided to the user. As an additional feature, material costs can be reduced because two pieces of convoluted foam can be produced form a single piece of foam. For example, two layers 28 may have a height of about 1¼ inch and be produced from a piece of foam having a height of about 1.5 inches. This allows two contoured foam pieces to have a combined height of 2.5 inches. This can reduce the cost of layer 28 (as compared to using a piece of flat foam) by up to about 50%. When this layer is combined with layer 30, a plush and luxurious feel is produced at a reduced cost. For example, layer 30 may be about one inch while layer 28 is about 1¼ inch. This is about the same height as the original foam piece from which layer 28 was produced, but has a much more luxurious and body-conforming feel.

Figure 5:
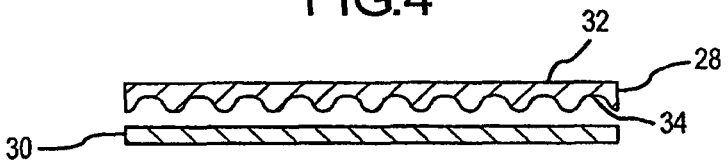
FIG. 5 is a side view of a convoluted foam layer adjacent another padding layer according to another embodiment of the invention.
Figure 6:
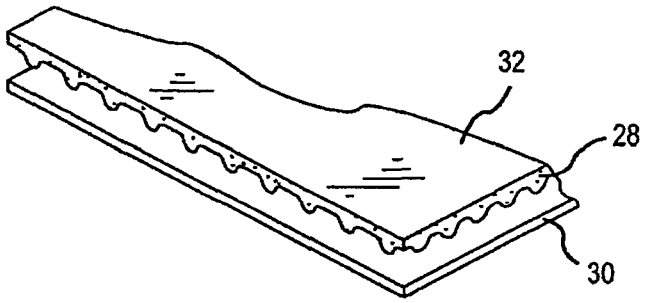
FIG. 6 is a perspective view of the arrangement of FIG. 5.

As shown in FIGS. 4 and 5, layers 28 and 30 may be flipped so that convoluted surface 34 faces toward core 12. Also, layer 30 is positioned between layer 28 and core 12.

Mattress 10 also includes a layer of ticking 40 that is a piece of fabric or quilting that envelopes the mattress as is known in the art. Ticking 40 may comprise essentially any type of fabric or covering and may be sewn to form it around the core and other padding layers. Layers 28 and 30 may be incorporated into ticking 40 using a gusset that runs beneath layer 30 to form a pillow top. The ticking 40 may be sewn to a nonwoven material that is positioned beneath layers 28 and 30. Alternatively, ticking 40 may be placed over layer 28 and along the sides of the mattress to form a plush top mattress.

As mentioned herein, intermediate layers may be positioned between core 12 and layers 28 and 30. In some cases, additional layers could also be placed on top of layers 28 and 30. As another variation, a mattress may include multiple combinations of layers 28 and 30 on the same side of the core. These could be adjacent to each other or separated by other layers. Mattress 10 may be configured as a traditional two sided mattress or a one-sided or so-called no-flip mattress. For a one-sided mattress configuration, side 22 of core 12 may include a bottom support layer 42. A variety of materials may be used to construct layer 42 including a matrix of foam elements, polyurethane foam, and the like. Examples of how to construct layer 42 and to couple it to core 12 are described in U.S. Application No. 6,643,876 incorporated herein by reference.

For a two sided mattress, the same layers that are included on side 20 may be replicated on side 22. In some cases, a different arrangement could be provided on side 22 to provide a mattress having different comfort levels for each side.

In some cases, two padding layers 30 may be used in combination with padding layer 28 having the contoured surface. The padding layers 30 may both be positioned on top of layer 28, or one may be above and one below. In another alternative, the mattress may include two layers 28 of foam that are contoured in combination with layer 30. For example, the two layers 28 may have their contoured surfaces facing up, with layer 30 resting on the contoured surface of the top layer 28. As another example, one of the layers 28 may having its contoured surface facing up with the other layer 28 having its contoured surface facing down. Layer 30 rests on the contoured surface of the top layer 28.

Figure 7:
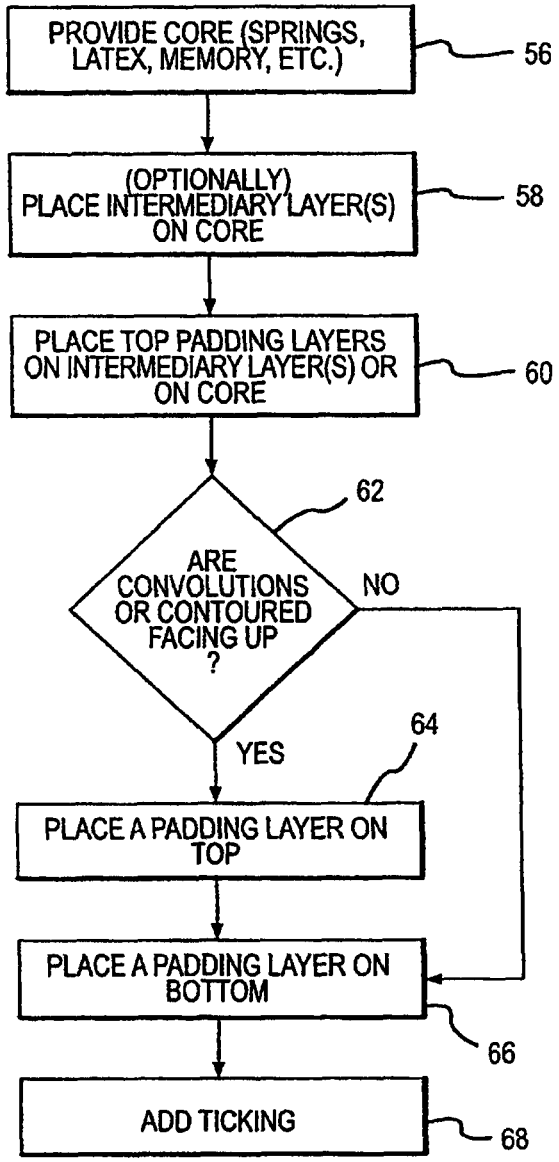
FIG. 7 is a flow chart illustrating one method for making a mattress according to the invention.

Referring now to FIG. 7, one method for constructing a mattress will be described. As shown in step 56, the process utilizes a core. This may be any of the cores described herein. Optionally, one or more intermediary layers may be placed adjacent the core as shown in step 58. A set of top padding layers are placed on the intermediary layers or adjacent the core as shown in step 60. One of the top padding layers may have convolutions or contours that face away from or toward the core as shown in step 62. If facing up or away from the core, a padding layer is placed on top of the contoured surface as shown in step 64. If facing down, the additional padding layer may be placed between the contoured surface and the core as shown in step 66. When all layers have been added, a layer of ticking is placed around the mattress to complete its construction as shown in step 68. In cases where the top padding layers are incorporated into the ticking to form a pillow top mattress, these steps may be done before placing the ticking around the mattress.

The mattresses described above, as well as other mattress designs described herein, may further utilize fiberballs as a padding or cushion material. These fiberballs are individual clusters of fibers that are entangled together, and may be placed in certain locations within the mattress. In one particular aspect, the fiberballs may comprise a plurality of randomly arranged and entangled fibers having a size in the range from about 1 mm to about 20 mm. The fibers may in turn comprise polyester fibers having a cut length up to about 100 mm, although other fibers may be used. These fibers may be arranged in a variety of configurations. For example, the fibers may be conjugated or spirally crimped. When placed within a mattress, the fiberballs may be placed in layers, typically having a density that is in the range from about 0.5 ounces per square foot to about 3 ounces per square foot, and more preferably from about 0.75 ounces per square foot to about 2 ounces per square foot. Examples of fiberballs that may be used are described in, for example, U.S. Pat. Nos. 4,618,531; 4,794,038; 4,940,502; 4,818,599; 5,112,684; 5,154,969; 5,169,580 and 5,218,740, incorporated herein by reference.

Figure 8:
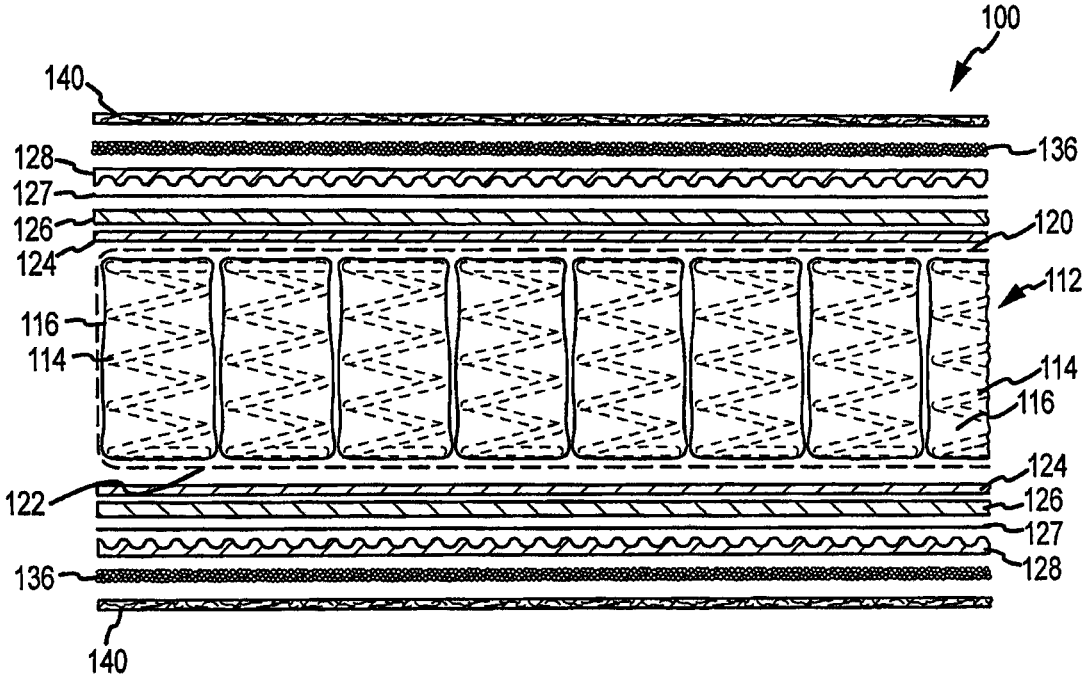
FIG. 8 is an exploded, schematic side view of another embodiment of a mattress using fiberballs according to the invention.
Figure 9:
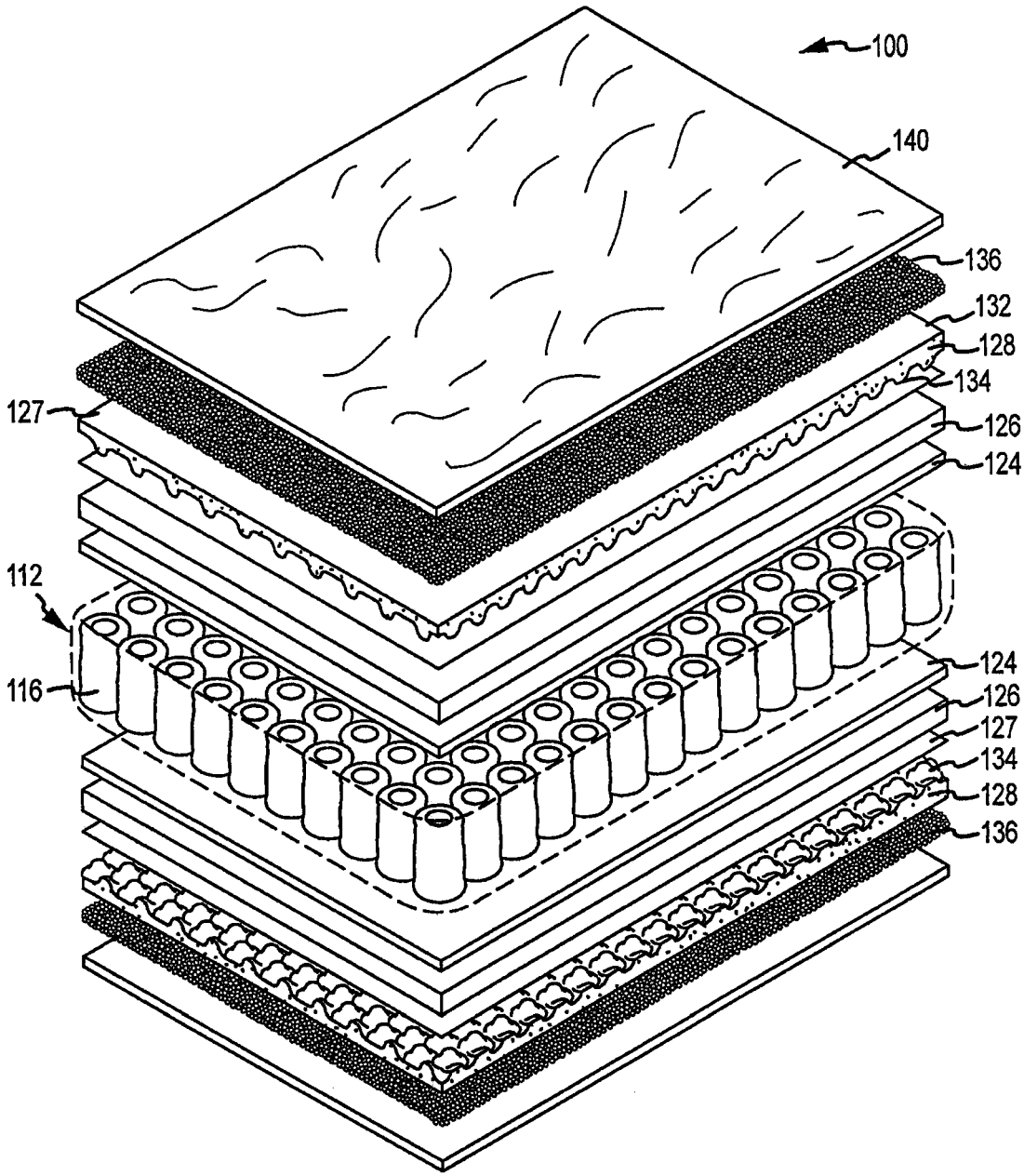
FIG. 9 is a perspective view of the mattress of FIG. 8.
Figure 10:
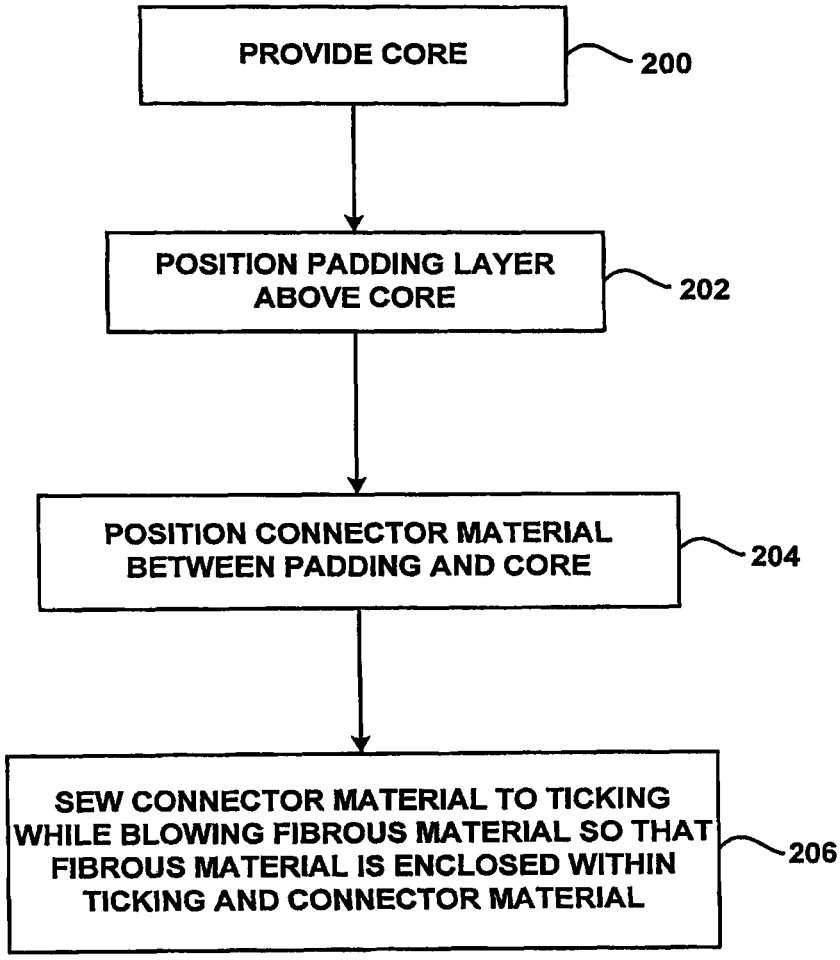
FIG. 10 is a flowchart of one method for constructing a mattress.

Referring now to FIGS. 8 and 9, another embodiment of a mattress 100 will be described. Mattress 100 utilizes a core 112 that provides the basic layer of support to the user's body. Mattress 100 may be used with essentially any type of core 112. For example, core 112 may comprise springs 114 that are encased in fabric pockets 116. Other cores include traditional open coil springs, latex rubber cores, visco-elastic cores, polyurethane cores, air bladders, waterbed cores, and the like. Hence, the invention is not intended to be limited to only a specific type of core. A border rod may be used to couple the core to an adjacent layer, although in some instances a foam casing or other border material may be placed around the core and the other layers.

For convenience of discussion, core 112 may have a first side 120 and a second side 122. A variety of optional padding layers and/or fabrics may be positioned adjacent to first side 120 and second side 122. For instance, a backing material (such as a nonwoven material, a fiber pad, a fine wire material, or the like) may be placed next to core 112 for protection of core 112. One or more intermediate padding layers (such as layers 124 and 126) may be used to provide the mattress with additional comfort. These layers may be used alone or in various combinations.

Positioned above core 112 (and above layers 124 and 126 if used) is a connector material 127 that is used in combination with a ticking 140 to enclose one or more other padding layers. Connector material 127 may comprise a material that may be sewn to ticking 140, such as a nonwoven fabric. Examples of materials that may be used for ticking 140 include a jacquard damask, a circular stretch knit, or the like.

Positioned on top of connector material 127 is a padding layer 128. Padding layer 128 may be constructed of essentially any type of padded material. In one aspect, padding layer 128 has a planar surface and a contoured surface, although in some cases both sides could be planar. By way of example, one type of contoured surface is a convoluted surface having alternating peaks and valleys similar to an egg carton. One example of this type of surface design is described in U.S. Pat. No. 5,317,768, incorporated herein by reference. Other types of contoured surfaces include ribs, zigzags, other surface modified foams that may have essentially any type of design, including patterns defining regions of higher and lower firmness, and the like.

The padding layer having the contoured surface may be constructed from a polyurethane foam, although other materials could be used as well. As illustrated in FIG. 9, layer 128 comprises a polyurethane foam having a flat surface 132 and a convoluted surface 134 that faces core 112. The convoluted surface provides the mattress with a comfortable feel as described with other embodiments described herein.

Moreover, positioned on flat surface 132 are a layer of fiberballs 136 which are arranged so that they are enclosed between layer 128 and ticking 140, although in some cases, one or more padding layer could be provided on top of fiberballs 136. Examples of such layers include any of those described herein, such as a Quiltflex foam, other foams, including polyurethane foams, rubbers, visco-elastic materials and the like, and may have similar, firmnesses, densities and thicknesses. These layers may have planar or convoluted surfaces. For instance, the convolutions could be facing toward the layer of fiberballs. The layer of fiberballs 136 is arranged such that the sleeping surface is more soft and resilient and provides the user with additional comfort as compared to traditional polyurethane foam pads. Also, in some cases the fiberballs may also reduce the cost of the mattress while providing a more luxurious feel. For example, fiberballs can be less expensive than polyurethane foams. Further, the fiberballs permit increased air circulation within the mattress to wick away body moisture and to disperse body heat away from the user.

Although shown with a single layer of fiberballs, it will be appreciated that additional layers could be provided on one or both sides of core 112. For example, a layer of polyurethane foam or other padding material could be sandwiched between two layers of fiberballs. Other arrangements are possible as well. One advantage of having the fiberballs close to ticking 140 is that the user is better able to feel the softness and resilience of the fiberballs when lying on the mattress.

One exemplary way to construct mattress 100, is to begin with core 112 and then add any additional layers, such as layers 124 and 126, if desired. To incorporate layer 128 and fiberballs 130 into the mattress, a modified quilting machine may be used. Such a quilting machine may be one such as a Mammut or a Gribetz machine that has been altered to include a blower that blows a supply of fiberballs onto layer 128 just prior to sewing. More specifically, as the quilting machine begins to sew ticking 140 to connector material 127, the blower blows the fiberballs onto the flat surface 132 just behind were the stitching occurs. In this way, the fiberballs are enveloped by the ticking 140 and connector material 127 so that they build up as a layer on flat surface 132. As the quilting machine continues its stitching along the mattress, the fiberball layer continues to be deposited until flat surface 132 is entirely covered and the stitching is completed. In this way, mattress 100 may be completed in an automated manner, with a generally even layer of fiberballs deposited below ticking 140.

The invention has now been described in detail for purposes of clarity and understanding. However, it will be appreciated that certain changes and modifications may be practiced within the scope of the appended claims.

What is claimed is:

1. A method for constructing a mattress, the method comprising:

providing a core having a first side and a second side;

positioning a connector material above the first side of the core;

blowing a supply of fibrous material with a blower;

depositing a blown supply of fibrous material above the connector material;

using a quilting machine, sewing the connector material to a ticking using stitching to form a quilting that envelops the fibrous material; and continuing to deposit the blown supply of fibrous material as the quilting machine stitches behind the deposited fibrous material.

2. A method as claimed in claim 1, wherein the fibrous material comprises fiberballs.

3. A method as in claim 2, wherein the fiberballs that comprise a plurality of randomly arranged and entangled fibers having a size in the range from about 1 mm to about 20 mm.

4. A method as in claim 1, wherein the fibrous material comprises a cut material.

5. A method as in claim 4, wherein the cut material comprises cut fibers.

6. A method as in claim 5, wherein the cut fibers comprise polyester fibers having a cut length up to about 100 mm and are conjugated or spirally crimped.

7. A method as in claim 1, further comprising including a padding layer above the connector material, wherein the padding layer comprises a polyurethane foam having a contoured surface, and wherein the contoured surface is convoluted.

8. A method as in claim 1, wherein the layer of fibrous material has a density that is in the range from about 0.5 ounces per square foot to about 3 ounces per square foot.

9. A method as in claim 1, further comprising a padding layer having a contoured surface that faces toward the core.

10. A method as in claim 9, further comprising a padding element disposed between the core and the padding layer.

11. A method as in claim 10, wherein the padding element is selected from a group of materials consisting of polyurethane foam, latex and visco-elastic materials.

12. A method as in claim 9, wherein the padding layer has a thickness in the range from about ⅜ inch to about 3 inches.

13. A method as in claim 1, wherein the core is selected from a group consisting of spring cores, latex cores, visco-elastic cores and bladders.

14. A method as in claim 1, wherein the fibrous material is deposited just prior to sewing such that, as the quilting machine begins sewing the connector material to the ticking, the fibrous material is continuously deposited just behind where stitching occurs.

15. A method for constructing a mattress, the method comprising:

providing a core having a first side and a second side;

providing a layer of padding material that comprises a visco-elastic material;

positioning a connector material above the first side of the core;

blowing a supply of fibrous material with a blower;

depositing the blown supply of fibrous material above the connector material;

using a quilting machine, sewing the connector material to a ticking using stitching to form a quilting that envelops the fibrous material; and continuing to deposit the blown supply of fibrous material as the quilting machine stitches behind the deposited fibrous material.

16. A method as in claim 15, wherein the fibrous material comprises fiberballs.

17. A method as in claim 15, wherein the fibrous material is deposited just prior to sewing such that, as the quilting machine begins sewing the connector material to the ticking, the fibrous material is continuously deposited just behind where stitching occurs.

* * * * *